US010781995B2

(12) United States Patent
Wang et al.

(10) Patent No.: US 10,781,995 B2
(45) Date of Patent: Sep. 22, 2020

(54) LIGHTING APPARATUS

(71) Applicant: GE LIGHTING SOLUTIONS, LLC, East Cleveland, OH (US)

(72) Inventors: Tingting Wang, ShangHai (CN); Qi Long, ShangHai (CN); Min Fang, ShangHai (CN); Honglei Gao, ShangHai (CN); Shuyi Qin, ShangHai (CN)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 71 days.

(21) Appl. No.: 15/756,726

(22) PCT Filed: Sep. 19, 2016

(86) PCT No.: PCT/CN2016/099300
§ 371 (c)(1),
(2) Date: Mar. 1, 2018

(87) PCT Pub. No.: WO2017/050194
PCT Pub. Date: Mar. 30, 2017

(65) Prior Publication Data

US 2018/0340668 A1 Nov. 29, 2018

(30) Foreign Application Priority Data

Sep. 24, 2015 (CN) ..... 2015 1 0616378

(51) Int. Cl.
*F21V 21/00* (2006.01)
*F21V 1/00* (2006.01)
(Continued)

(52) U.S. Cl.
CPC ..... *F21V 1/00* (2013.01); *F21V 23/04* (2013.01); *F21Y 2103/00* (2013.01); *F21Y 2113/00* (2013.01); *F21Y 2115/10* (2016.08)

(58) Field of Classification Search
CPC ..... F21V 1/00; F21V 23/04; F21Y 2113/00
(Continued)

(56) References Cited

U.S. PATENT DOCUMENTS 7,121,684 B2 * 10/2006 Barozzini ..... F21S 9/022 362/228
9,119,668 B2 * 9/2015 Marka ..... A61B 90/35
(Continued)

FOREIGN PATENT DOCUMENTS

CN 1717958 A 1/2006
CN 101438096 A 5/2009
(Continued)

OTHER PUBLICATIONS

Machine Translation and International Search Report and Written Opinion issued in connection with corresponding PCT Application No. PCT/CN2016/099300 dated Dec. 22, 2016.
(Continued)

*Primary Examiner* — Laura K Tso
(74) *Attorney, Agent, or Firm* — Buckley, Maschoff & Talwalkar LLC

(57) ABSTRACT

The present invention relates to an illumination device, including: a support member; and at least one first light source on the support member and at least one second light source on the support member, where the first light source has a first light distribution, the second light source has a second light distribution, and the first light distribution is different from the second light distribution.

11 Claims, 11 Drawing Sheets

(51) Int. Cl.

| | |
|---|---|
| ***F21V 23/04*** | (2006.01) |
| *F21Y 103/00* | (2016.01) |
| *F21Y 115/10* | (2016.01) |
| *F21Y 113/00* | (2016.01) |

(58) Field of Classification Search
USPC ..... 362/225, 228
See application file for complete search history.

(56) References Cited

U.S. PATENT DOCUMENTS

| | | | | |
|---|---|---|---|---|
| 9,234,635 | B2 * | 1/2016 | Kwisthout | F21K 9/232 |
| 9,328,900 | B2 * | 5/2016 | Pachler | F21V 21/002 |
| 2007/0236926 | A1 * | 10/2007 | Guard | B64D 11/00 362/228 |
| 2008/0259596 | A1 * | 10/2008 | Biebl | F21V 7/0008 362/228 |
| 2008/0272937 | A1 * | 11/2008 | That | H05B 45/50 340/947 |
| 2011/0031894 | A1 * | 2/2011 | Van De Ven | F21K 9/00 315/294 |
| 2013/0042510 | A1 * | 2/2013 | Nall | F21V 5/04 40/541 |
| 2013/0294063 | A1 * | 11/2013 | Lou | F21V 7/005 362/225 |
| 2014/0119001 | A1 * | 5/2014 | Zhang | F21V 5/04 362/225 |
| 2014/0254153 | A1 * | 9/2014 | Vissenberg | F21V 7/0016 362/235 |
| 2014/0321115 | A1 * | 10/2014 | Goldstein | F21S 10/02 362/231 |

FOREIGN PATENT DOCUMENTS

| | | | |
|---|---|---|---|
| CN | 101513123 | A | 8/2009 |
| CN | 201434238 | Y | 3/2010 |
| CN | 201475812 | U | 5/2010 |
| CN | 101769459 | A | 7/2010 |
| CN | 102022637 | A | 4/2011 |
| CN | 201803160 | U | 4/2011 |
| CN | 102958256 | A | 3/2013 |
| CN | 103270363 | A | 8/2013 |
| CN | 103403442 | A | 11/2013 |
| CN | 103527939 | A | 1/2014 |
| CN | 103874878 | A | 6/2014 |
| CN | 103930714 | A | 7/2014 |
| CN | 104769644 | A | 7/2015 |
| JP | 2008-078087 | A | 4/2008 |
| JP | 2010-205553 | A | 9/2010 |
| JP | 2015-122205 | A | 7/2015 |
| WO | 2011/039690 | A1 | 4/2011 |

OTHER PUBLICATIONS

Machine Translation and First Office Action and Search issued in connection with corresponding CN Application No. 201510616378.9 dated Sep. 29, 2017.

Decision of Rejection issued in connection with corresponding CN Application No. 201510616378.9 dated Apr. 28, 2019.

Fourth Office Action and Search issued in connection with corresponding CN Application No. 201510616378.9 dated Sep. 6, 2019.

* cited by examiner

LIGHTING APPARATUS

TECHNICAL FIELD

The present invention relates to the field of lighting technologies, and in particular, to an illumination device.

BACKGROUND OF THE INVENTION

A light distribution provided by a light source is usually constant. However, illumination devices with various light distributions are required to meet different lighting needs. Therefore, to provide diversified light distributions, it is necessary in the prior art to adopt an additional optical element (such as a lens, a reflector, or a diffuser) independent of a light source, so as to change an optical path of light emitted from the light source.

The Chinese Patent Application No. CN101438096 provides a specific implementation solution of the above prior art, including: an illumination device including a light source; an electrowetting optical element disposed in front of the light source to allow refraction of a light beam emitted from the light source; and a driving device configured to operate the optical element in at least two predetermined states, the states being adapted to generate refracted beams having different light intensity distributions.

However, this additional optical element is usually expensive and increases the cost of an entire illumination device.

In this case, there is a need for a new illumination device that provides diversified light distributions.

SUMMARY OF INVENTION

An objective of the present invention is to provide an illumination device.

According to an aspect, an embodiment of the present invention relates to an illumination device, including: a support member; and at least one first light source on the support member and at least one second light source on the support member, where the first light source has a first light distribution, the second light source has a second light distribution, and the first light distribution is different from the second light distribution.

BRIEF DESCRIPTION OF DRAWINGS

To read the following detailed description with reference to the accompanying drawings can help understand the features, aspects and advantages of the present invention, where.

DETAILED DESCRIPTION

"Comprise", "include", "have", and similar terms used in the present application are meant to encompass the items listed thereafter and equivalents thereof as well as other additional items. Approximating language in the present application is used to modify a quantity, indicating that the present invention is not limited to the specific quantity, and may include modified parts that are close to the quantity, acceptable, and do not lead to change of related basic functions. Accordingly, the use of "about" or the like modifies a numerical value, meaning that the present invention is not limited to the precise numerical value. In some embodiments, an approximate term may correspond to the accuracy of an instrument that measures a value.

In the specifications and claims, unless otherwise clearly indicated, no limitation is imposed on singularity and plurality of all items. Throughout this patent application specification and claims, "first", "second" and similar words do not denote any order, quantity, or importance, but are used to distinguish the different materials and embodiments.

Unless otherwise clearly indicated, the terms "OR", "or" do not mean exclusiveness, but mean at least one of the mentioned item (such as ingredients), and include a situation where a combination of the mentioned exists.

"Some embodiments" and the like mentioned in the present application specification represent that specific elements (such as a characteristic, structure, and/or feature) related to the present invention are included in at least one embodiment described in the specification, and may or may not appear in another embodiment. In addition, it should be understood that the invention elements can be combined in any manner.

The following describes the embodiments of the present invention with reference to the accompanying drawings, and may not describe in detail functions or structures that are well known, to prevent unnecessary details that may make the present invention hard to understand.

Figure 1:
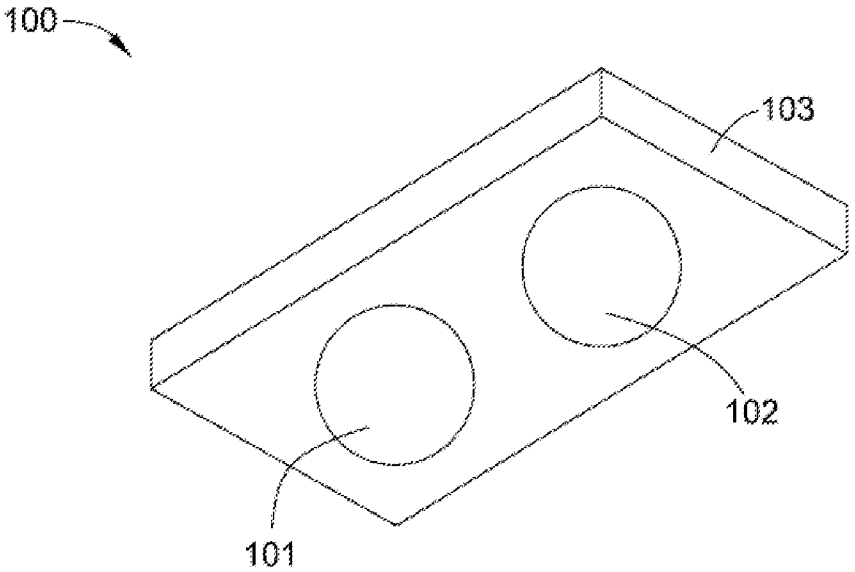
FIG. 1 is a schematic structural diagram of an illumination device involved in an embodiment of the present invention.

FIG. 1 shows one embodiment of an illumination device 100. The illumination device 100 includes a support member 103, and at least one first light source 101 and at least one second light source 102 on the support member 103.

The support member 103 is mainly used to support the first light source 101 and the second light source 102. In some embodiments, a relative position between the first light source 101 and the second light source 102 is fixed by the support member 103. In some embodiments, the first light source 101 and the second light source 102 are arranged on the support member 103, but a relative position between the first light source 101 and the second light source 102 can be adjusted. The support member 103 may include any component that can be used to support the first light source 101 and the second light source 102, for example, a panel that can fix the first light source 101 and the second light source 102, or any component that can fix the first light source 101 and the second light source 102 provided thereon.

The first light source 101 and the second light source 102 include any element that can function as a light emitting source. In some embodiments, the first light source 101 and the second light source 102 are integrated into one lamp.

In some embodiments in which the illumination device 100 is implemented based on a light-emitting diode (LED for short), the first light source 101 and the second light source 102 respectively include a complete LED, such as an encapsulated LED, that is, the first light source 101 and the second light source 102 do not include only a luminous PN junction (PN junction). For example, the first light source 101 is an encapsulated LED having a first light distribution, and the second light source 102 is an encapsulated LED having a second light distribution.

The first light source 101 has a first light distribution, the second light source 102 has a second light distribution, and the first light distribution is different from the second light distribution. The "light distribution" may also be referred to as "light intensity distribution", indicating a luminous intensity value in all directions of space.

Figure 11:
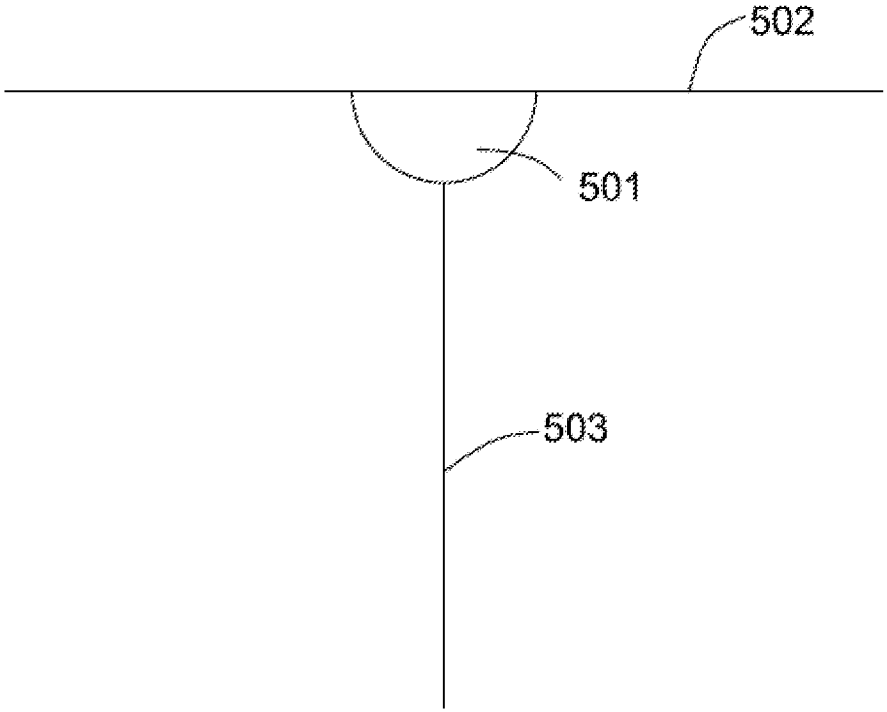
FIG. 11 is a schematic diagram of a beam center line of an embodiment.

In some embodiments, the first light distribution includes a narrow beam angle distribution, and the second light distribution includes a wide beam angle distribution. A beam angle (beam angle) represents an angle between two directions in which a light intensity is equal to N % of the maximum light intensity in the plane perpendicular to a beam centerline. In some embodiments, N=50; in some embodiments, N=10; and in some embodiments, N may be adjusted according to lighting needs. In general, the beam centerline passes through a light source and is perpendicular to a light emitting plane of the light source. FIG. 11 shows a simple example of a beam centerline, where 501 represents a light source, 502 represents a light emitting plane, and 503 represents the beam centerline. FIG. 11 is only used to better illustrate the beam centerline and should not be construed as a limitation of the concept of the beam centerline.

As an example of a narrow beam angle distribution, the first light distribution includes a Lambertian distribution (Lambertian distribution). Accordingly, the first light source 101 may include any light source having a Lambertian distribution, such as a Lambertian LED.

Figure 2:
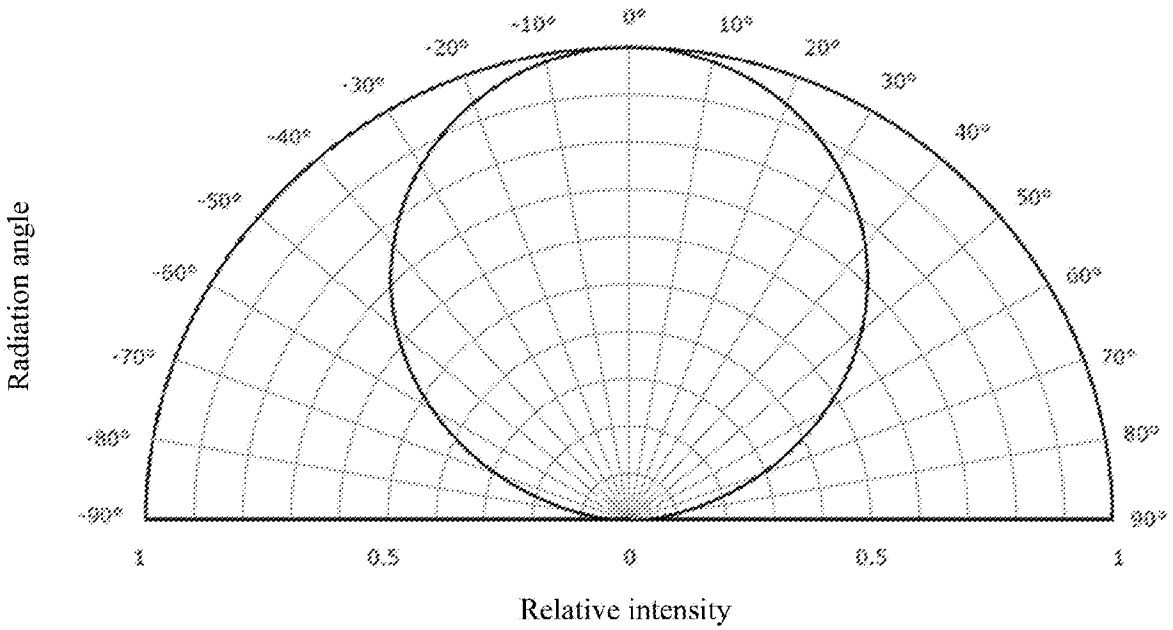
FIG. 2 is a schematic diagram of an ideal Lambertian distribution.

FIG. 2 shows an example of an ideal Lambertian distribution in a polar coordinate system, where a polar angle represents a radiation angle and a polar diameter represents a relative intensity. It should be noted that the "Lambertian distribution" in the present invention is not limited to the ideal Lambertian distribution but also includes a near-Lambertian distribution close to the ideal Lambert distribution. It should be noted that the narrow beam angle distribution is not limited to the Lambertian distribution. As an example, the narrow beam angle distribution may include any light distribution with a beam angle less than or equal to a specified angle, where the specified angle may be about 120 degrees, or may also be another angle.

As an example of a wide beam angle distribution, the second light distribution includes a bat-wing distribution, which may also be referred to as a butterfly wing distribution. Accordingly, the second light source 102 may include any light source having a bat-wing distribution, such as a flip-chip LED.

Figure 3:
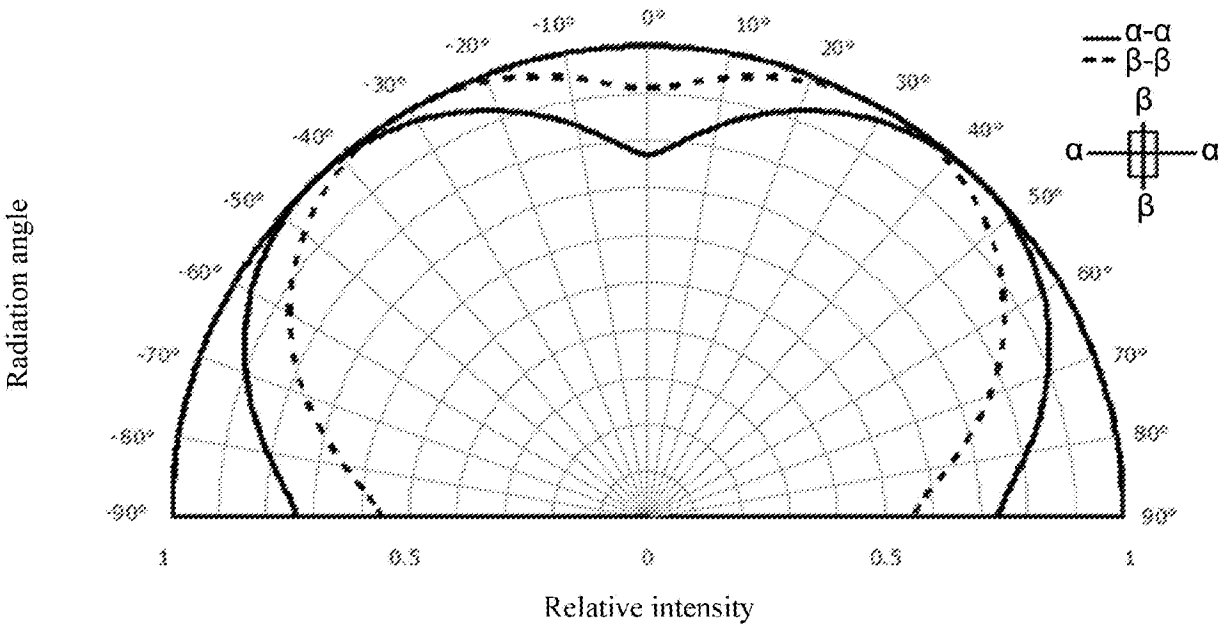
FIG. 3 is a schematic diagram of a bat-wing distribution.

FIG. 3 shows an example of an asymmetric bat-wing distribution in a polar coordinate system, where a polar angle represents a radiation angle and a polar diameter represents a relative intensity. The "asymmetrical bat-wing distribution" indicates light distributions of the bat-wing distribution may be different in a plurality of planes including a beam centerline. In FIG. 3, $\alpha$ and $\beta$ represent light distributions in two planes including a beam centerline and perpendicular to each other.

It can be seen from FIG. 2 and FIG. 3, the bat-wing distribution has a wider beam angle than the Lambertian distribution. It should be noted that the "bat-wing distribution" herein is not limited to the light distribution shown in FIG. 3. For example, the bat-wing distribution may be a symmetrical light distribution. For another example, the shape of a bat-wing distribution curve may be different from that shown in FIG. 3. It should be noted that the wide beam angle distribution is not limited to the bat-wing distribution. As an example, the wide beam angle distribution may include any light distribution with a beam angle greater than the foregoing specified angle.

By setting a light output intensity ratio between the first light source 101 and the second light source 102, modulation of a light distribution of the illumination device 100 can be achieved without using an optical element such as a lens, a reflector, or a diffuser.

As an implementation, the light output intensity ratio between the first light source 101 and the second light source 102 can be set by setting a ratio of a current intensity provided to the first light source 101 and the second light source 102.

Figure 4:
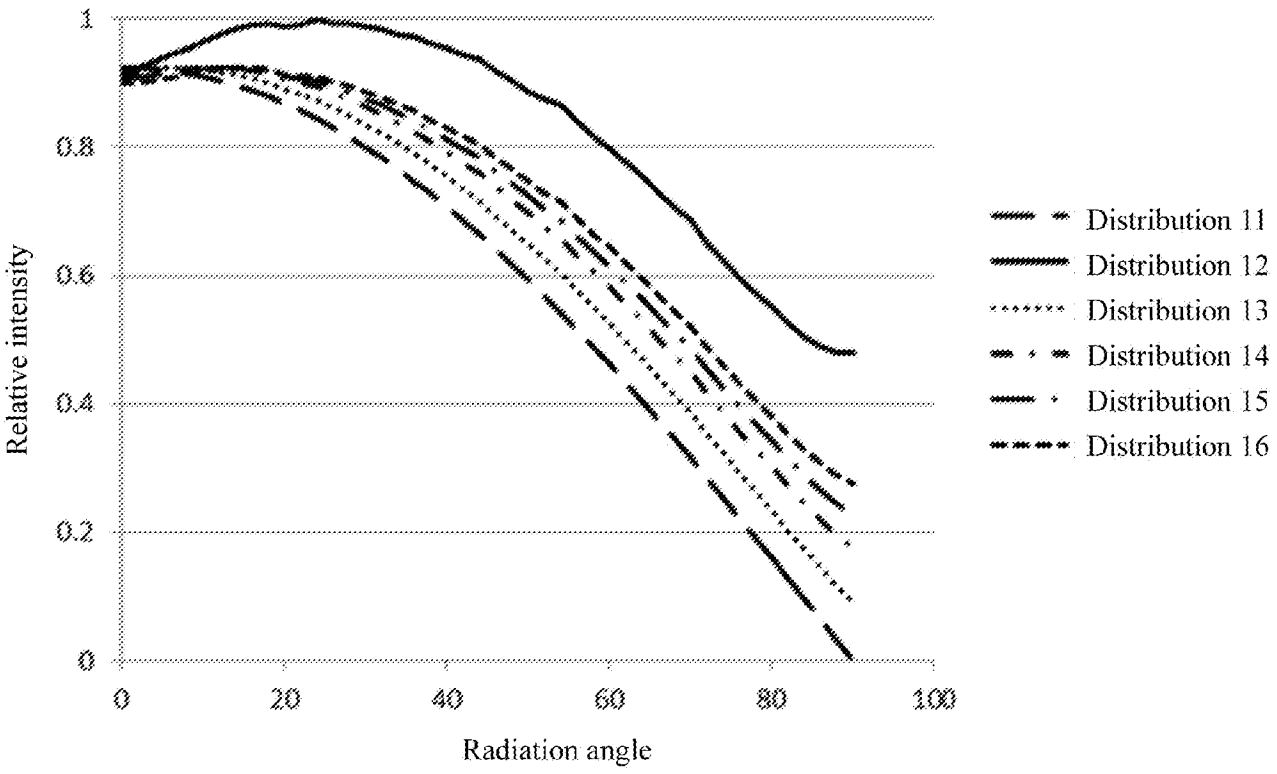
FIG. 4 is a schematic diagram of corresponding light distributions of an illumination device at multiple current intensity ratios involved in an embodiment of the present invention.

FIG. 4 shows corresponding light distributions of the illumination device 100 at different current intensity ratios between the first light source 101 and the second light source 102 in a rectangular coordinate system.

In FIG. 4, a light distribution 11 indicates a Lambertian distribution of the first light source 101, a light distribution 12 indicates a bat-wing distribution of the second light source 102, a light distribution 13 indicates a light distribution of the illumination device 100 when a current intensity ratio between the first light source 101 and the second light source 102 is 1:1, a light distribution 14 indicates a light distribution of the illumination device 100 when a current intensity ratio between the first light source 101 and the second light source 102 is 1:3, a light distribution 15 indicates a light distribution of the illumination device 100 when a current intensity ratio between the first light source 101 and the second light source 102 is 1:5, and a light distribution 16 indicates a light distribution of the illumination device 100 when a current intensity ratio between the first light source 101 and the second light source 102 is 1:8.

It can be seen from FIG. 4 that the light distribution of the illumination device 100 changes accordingly as the current intensity ratio between the first light source 101 and the second light source 102 changes.

Figure 5:
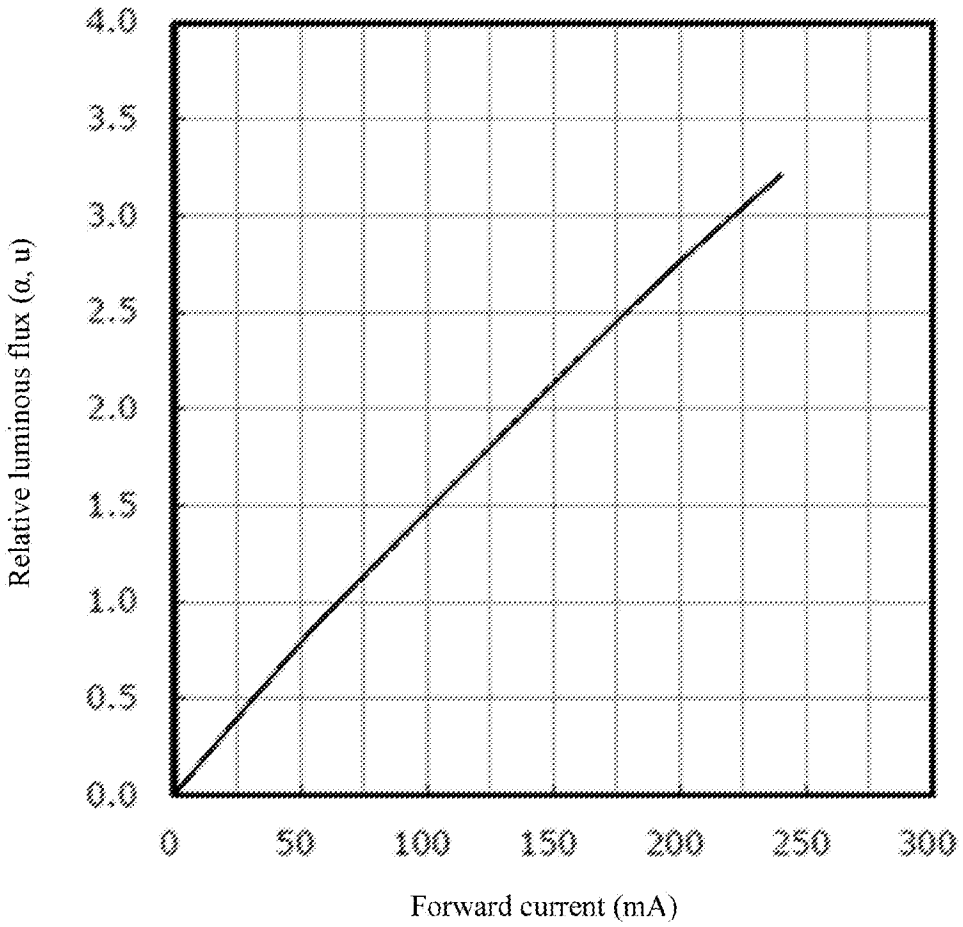
FIG. 5 is a schematic diagram of relative luminous flux varying with a forward current.

FIG. 5 shows a schematic diagram of relative luminous flux (relative luminous flux) of an LED varying with a forward current (forward current) at a room temperature about 25 degrees in a rectangular coordinate system. The relative luminous flux indicates a ratio between luminous flux of an LED supplied with another current and luminous flux of the LED supplied with a rated current at a room temperature about 25 degrees. It can be defined that the LED has luminous flux of 1 when supplied with a rated current at a room temperature about 25 degrees.

Figure 6:
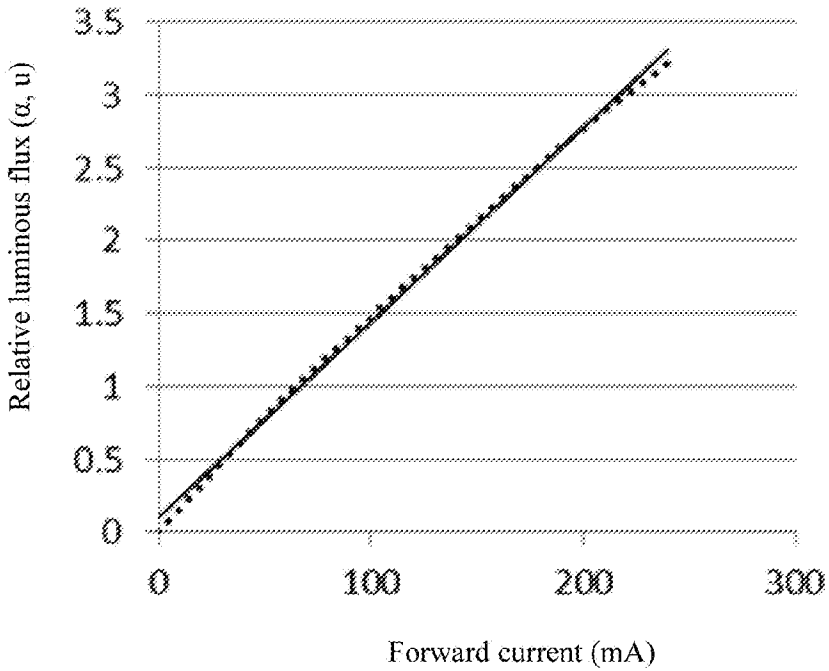
FIG. 6 is a schematic diagram of linear fitting on a relative luminous flux curve shown in FIG. 5.

FIG. 6 shows a result of linear fitting on a relative luminous flux curve shown in FIG. 5 in a rectangular coordinate system. Dotted lines in FIG. 6 indicate partial points in the curve shown in FIG. 5, and solid lines in FIG. 6 indicate a result of linear fitting on points indicated by the dotted lines.

It can be seen from FIG. 6 that the relative luminous flux can be approximately assumed to increase linearly with the increase of the forward current. Therefore, in virtue of this characteristic, the current intensity ratio between the first light source 101 and the second light source 102 can be completely set according to actual needs without being limited to the specific numerical values shown in FIG. 4.

As another implementation, the light output intensity ratio between the first light source 101 and the second light source 102 can be set by setting a quantity ratio between the first light source 101 and the second light source 102. That is, in this implementation, the number of the first light sources 101 and/or the second light sources 102 may be multiple (not shown). It should be noted that the plurality of first light sources 101 have the same or similar light distribution, but the encapsulation between the plurality of first light sources 101 may be different; similarly, the plurality of second light sources 102 have the same or similar light distribution, but the encapsulation between the plurality of second light sources 102 may be different.

Figure 7:
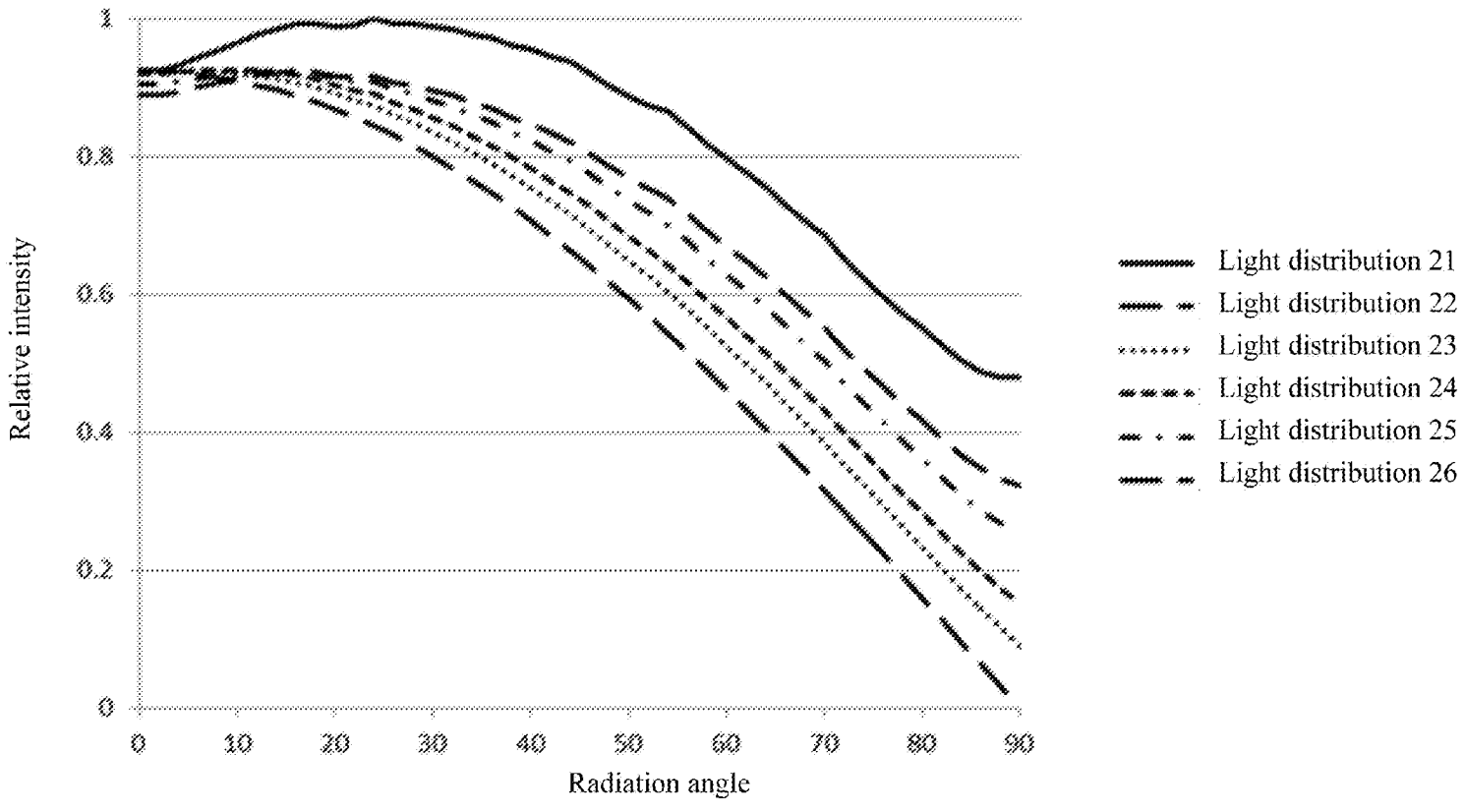
FIG. 7 is a schematic diagram of light distributions of an illumination device at multiple light source quantity ratios involved in an embodiment of the present invention.

FIG. 7 shows light distributions of the illumination device 100 at different light source quantity ratios between the first light source 101 and the second light source 102 in a rectangular coordinate system, where current intensities supplied to the first light source 101 and the second light source 102 are the same.

In FIG. 7, a light distribution 21 indicates a bat-wing distribution of the second light source 102, a light distribution 22 indicates a Lambertian distribution of the first light source 101, a light distribution 23 indicates a light distribution of the illumination device 100 when a light source quantity ratio between the first light source 101 and the second light source 102 is 1:1, a light distribution 24 indicates a light distribution of the illumination device 100 when a light source quantity ratio between the first light source 101 and the second light source 102 is 1:2, a light distribution 25 indicates a light distribution of the illumination device 100 when a light source quantity ratio between the first light source 101 and the second light source 102 is 1:5, and a light distribution 26 indicates a light distribution of the illumination device 100 when a light source quantity ratio between the first light source 101 and the second light source 102 is 1:10.

It can be seen from FIG. 7 that when supplied current intensity ratios are the same, the light distribution of the illumination device 100 changes accordingly as the light source quantity ratio between the first light source 101 and the second light source 102 changes.

It should be noted that those skilled in the art can fully understand that the light source quantity ratio between the first light source 101 and the second light source 102 can be completely set according to actual needs without being limited to the specific numerical values shown in FIG. 7. In addition, the light source quantity ratio between the first light source 101 and the second light source 102 and the current intensity ratio provided therebetween can be set simultaneously to better obtain a desired light distribution of the illumination device 100.

In some embodiments, the illumination device 100 does not have a lampshade or a lampshade that has an influence on the light distribution. In this case, the light distribution of the illumination device 100 may be directly formed on the basis of the light output intensity ratio between the first light distribution and the second light distribution. That is, the light distribution of the illumination device 100 is related only to the light output intensity ratio between the first light source 101 and the second light source 102.

Based on the above embodiments, it is possible to obtain the illumination device 100 having a diversified light distribution without any optical element (such as a lens, a reflector, or a diffuser) independent of a light source, thereby reducing the cost of the illumination device. Especially when the first light source 101 and the second light source 102 do not include an optical element mainly for changing a light distribution, the illumination device 100 may realize a diversified light distribution without including any optical element (such as a lens, a reflector, or a diffuser) mainly for changing the light distribution (or mainly for changing an optical path).

Figure 8:
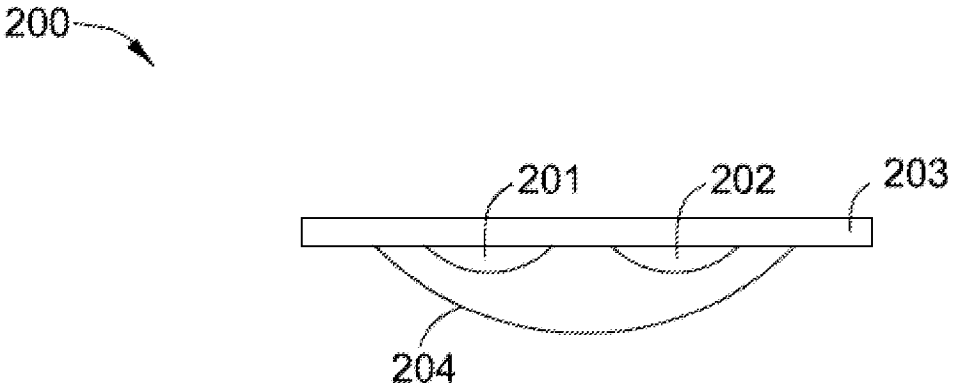
FIG. 8 is a schematic structural diagram of an illumination device involved in another embodiment of the present invention.

FIG. 8 shows one embodiment of an illumination device 200. The illumination device 200 includes a support member 203, at least one first light source 201 and at least one second light source 202 on the support member 203, and a lampshade 204. The support member 203, the first light source 201, and the second light source 202 are similar to the support member 103, the first light source 101, and the second light source 102 in FIG. 1, respectively, and are not described herein.

The first light source 102 and the second light source 202 are arranged inside the lampshade 204.

In some embodiments, the lampshade 204 can be mainly used for aesthetic decoration, dust prevention, preventing people from direct contact with a light source, light atomization, and the like. It should be noted that although the lampshade 204 may have some influence on a light distribution of the illumination device 200, the main function of the lampshade 204 is not to adjust the light distribution of the illumination device 200.

In an embodiment in which the lampshade 204 affects the light distribution of the illumination device 200, the light distribution of the illumination device 200 may be directly formed on the basis of an optical characteristic of the lampshade 204 and a light output intensity ratio between the first light distribution and the second light distribution. That is, in the embodiment in which the lampshade 204 affects the light distribution of the illumination device 200, the light distribution of the illumination device 200 may be directly formed on the basis of the optical characteristic of the lampshade 204 and a light output intensity ratio between the first light source 201 and the second light source 202. The optical characteristic of the lampshade 204 mainly include a characteristic of the lampshade 204 that affects an optical path, including but not limited to refraction, transmission, and reflection characteristics of the lampshade 204.

In this embodiment, it is possible to obtain the illumination device 200 having a diversified light distribution without any optical element (such as a lens, a reflector, or a diffuser) mainly for adjusting a light distribution and independent of a light source, thereby reducing the cost of the illumination device.

Figure 9:
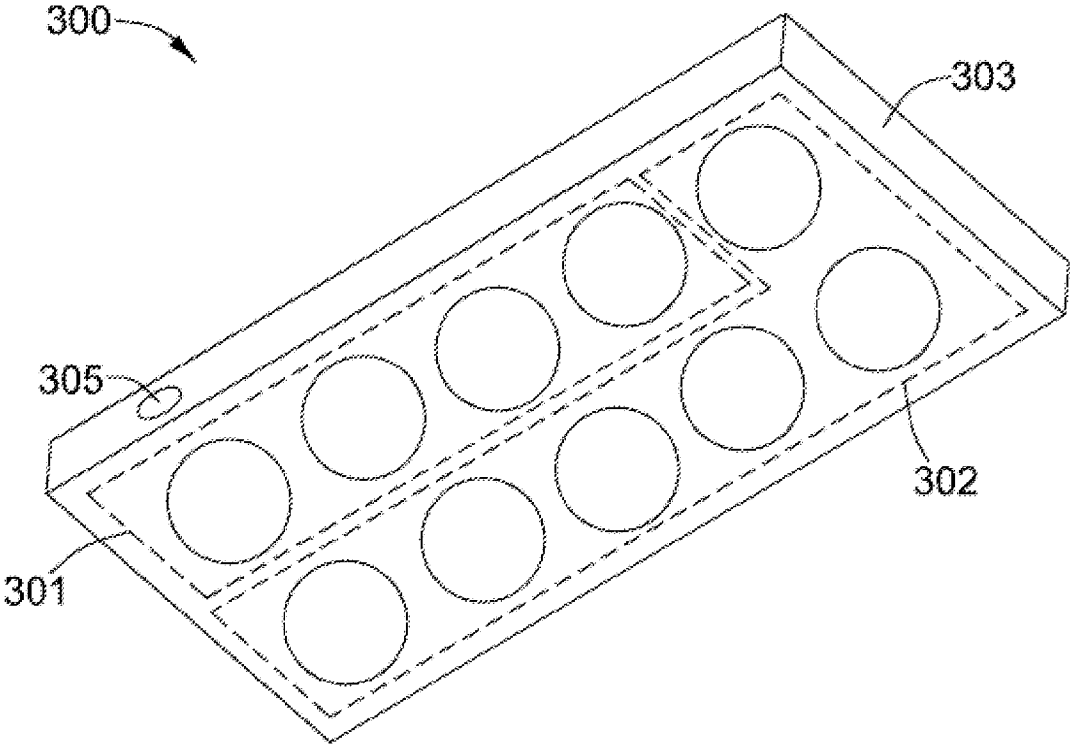
FIG. 9 is a schematic structural diagram of an illumination device involved in still another embodiment of the present invention.

FIG. 9 shows another embodiment of an illumination device 300. The illumination device 300 includes a support member 303, four first light sources 301, six second light sources 302, and an adjustment member 305. The dashed box in FIG. 9 is only used to identify the first light source 301 and the second light source 302.

The support member 303, the first light source 301, and the second light source 302 are similar to the support member 303, the first light source 301, and the second light source 302, respectively, and are not described herein.

The adjustment member 305 may be used to adjust a light output intensity corresponding to a light distribution. For example, the light output intensity corresponding to the first light distribution (that is, a total light output intensity of the first light source 301) is adjusted and/or the light output intensity corresponding to the second light distribution (that is, a total light output intensity of the second light source 302).

In some embodiments, the adjustment member 305 realizes the adjustment on the light output intensity corresponding to the first light distribution and/or the second light distribution by adjusting a current intensity provided to the first light source 301 and/or the second light source 302. For example, the adjustment member 305 is electrically connected to the first light source 301 and/or the second light source 302 to change the current intensity provided to the first light source 301 and/or the second light source 302. In these embodiments, the adjustment member 305 includes but is not limited to: a variable resistor, a dimmer, and the like. The dimmer includes but is not limited to: a 0-10V dimmer, a digital addressable lighting interface (DALI) dimmer, a wireless dimmer, and the like.

In some embodiments, the adjustment member 305 realizes the adjustment on the light output intensity corresponding to the first light distribution and/or the second light distribution by adjusting the quantity of the first light source 301 and/or the second light source 302 that actually contributes to the illumination. For example, the adjustment member 305 is electrically connected to the first light source 301 and/or the second light source 302 so as to control ON or OFF of current supplied to at least one of the first light sources 301 and/or at least one of the second light sources 302. In these embodiments, the adjustment member 305 includes but is not limited to: a switching circuit, a relay, and the like.

In some embodiments, the adjustment member 305 needs to be manually controlled directly. In this case, at least a part of the adjustment member 305 is exposed on a surface of the illumination device 300 for manual operation. In some embodiments, the adjustment member 305 may be remotely controlled. In this case, the adjustment member 305 may be completely hidden inside the illumination device 300 (this case is not shown).

In addition, compared with an influence of the light output intensity ratio between the first light source 301 and the second light source 302, an influence of the position between the first light source 301 and the second light source 302 on the light distribution can be neglected, and therefore, the positions of the first light source 301 and the second light source 302 in the illumination device 300 can be completely adjusted without being limited to that shown in FIG. 9.

Based on the embodiment shown in FIG. 9, a user may adjust the light distribution of the illumination device 300 as required.

Figure 10:
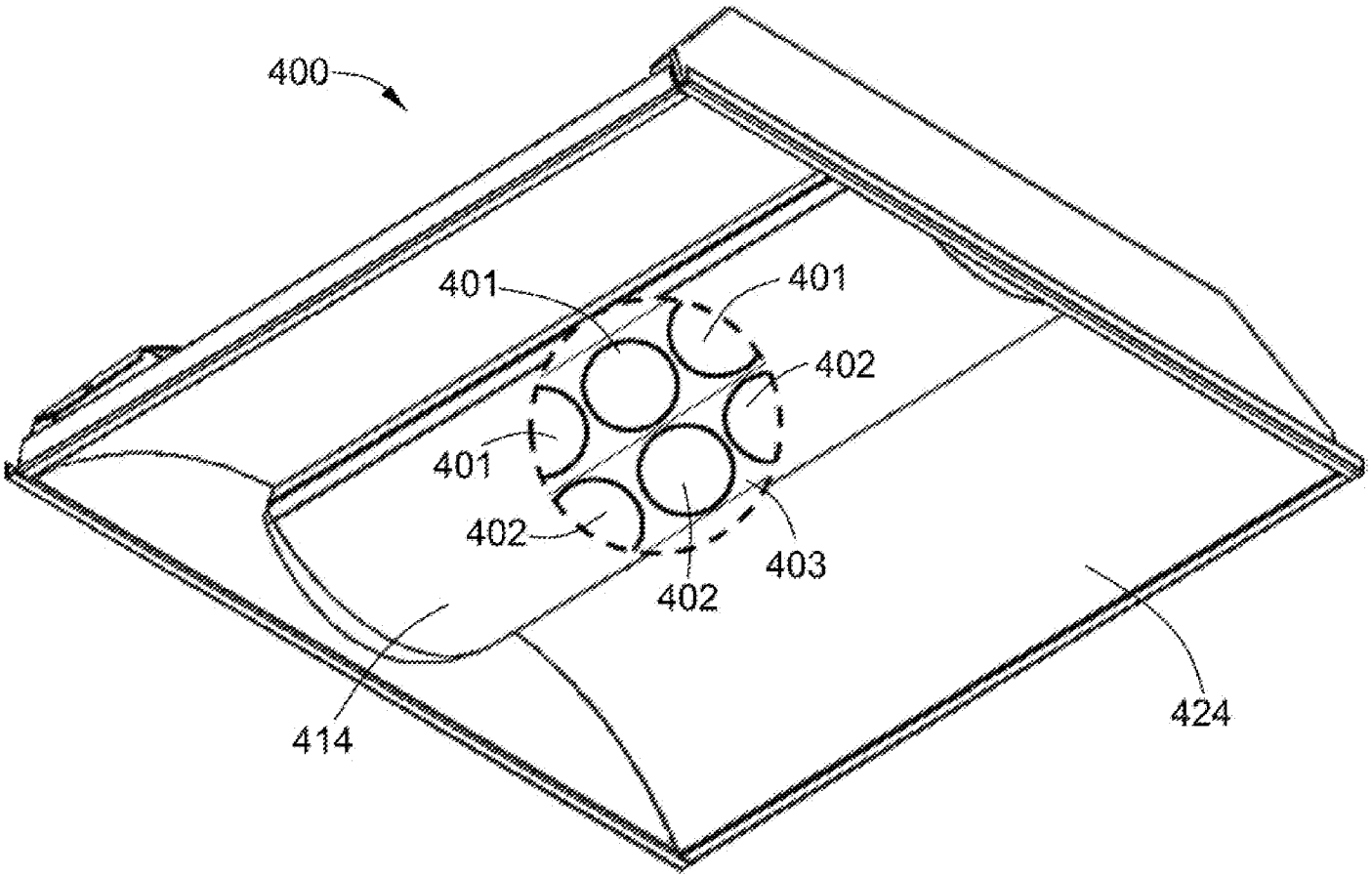
FIG. 10 is a schematic structural diagram of an illumination device involved in yet another embodiment of the present invention.

FIG. 10 shows another embodiment of an illumination device 400. The illumination device 400 includes a support member 403, a first light source 401, a second light source 402, and a lampshade that includes an inner cover 414 and a housing 424. The support member 403, the first light source 401, and the second light source 402 are similar to the support member 103, the first light source 101, and the second light source 102 in FIG. 1, respectively, and are not described herein.

The circular dashed box in FIG. 10 shows the support member 403 located inside the inner cover 414 and the first light source 401 and the second light source 402 provided on the support member 403. Both the first light source 401 and the second light source 402 are an LED lamp.

Compared with that of an incandescent lamp, a light distribution of an LED changes obviously with a radiation angle. Therefore, in general, instead of an incandescent lamp used as a light source, when an LED is used as a light source, it is difficult for the housing 424 of the illumination device 400 to be sufficiently illuminated without using an additional optical element to change the light distribution of the light source, thus affecting lighting effects and aesthetics of the illumination device 400. When an LED is used as a light source, by setting a light output intensity ratio between the first light source 401 and the second light source 402, the housing 424 can be sufficiently illuminated without using an optical element such as a lens, a reflector, or a diffuser.

It should be noted that although the foregoing embodiments only show the first light source and the second light source, the illumination device of the present invention may further include other light sources different from the light distributions of the first light source and the second light source. In addition, the modulation of the light distribution of the illumination device can be realized by setting a light output intensity corresponding to at least one light distribution.

While the present invention has been described with reference to specific embodiments thereof, it will be understood by those skilled in the art that many modifications and variations can be made thereto. It is, therefore, to be understood that the appended claims are intended to cover all such modifications and variations insofar as they are within the true spirit and scope of the invention.

What we claim is:

1. An illumination device, comprising:

a support member;

at least one first light source on the support member and at least one second light source on the support member, wherein the at least one first light source has a first light distribution, the at least one second light source has a second light distribution, the first light distribution is different from the second light distribution, and the first light distribution and the second light distribution collectively form a composite light distribution; and a single adjustment member to directly adjust a current intensity ratio of current provided to the at least one first light source and the at least one second light source to modify the composite light distribution.

2. The illumination device according to claim 1, wherein the composite light distribution of the illumination device is formed on the basis of a light output intensity ratio between the first light distribution and the second light distribution.

3. The illumination device according to claim 1, comprising:

a lampshade, wherein the first light source and the second light source are located inside the lampshade, and a light distribution of the illumination device is formed on the basis of an optical characteristic of the lampshade and a light output intensity ratio between the first light distribution and the second light distribution.

4. The illumination device according to claim 1, wherein the first light distribution comprises a narrow beam angle distribution, and the second light distribution comprises a wide beam angle distribution.

5. The illumination device according to claim 4, wherein the narrow beam angle distribution comprises a Lambertian distribution.

6. The illumination device according to claim 4, wherein the wide beam angle distribution comprises a bat-wing distribution.

7. The illumination device according to claim 1, wherein the first light source and the second light source respectively comprise an encapsulated LED.

8. The illumination device according to claim 1, wherein a light output intensity corresponding to a light distribution is adjustable.

9. The illumination device according to claim 8, wherein the light output intensity is adjusted by changing a quantity of light sources corresponding to a light distribution or a current intensity provided to a light source of a corresponding light distribution.

10. The illumination device according to claim 1, wherein the first light source and the second light source are integrated into one lamp.

11. An illumination device, comprising:

at least one first light source on a support member and at least one second light source on the support member, wherein the at least one first light source has a first light distribution, the at least one second light source has a second light distribution, the first light distribution is different from the second light distribution, and the first light distribution and the second light distribution collectively form a composite light distribution; and a dimmer to directly adjust a current intensity ratio of current provided to the at least one first light source and the at least one second light source to modify the composite light distribution.

* * * * *